US006336763B1

(12) United States Patent
Losier et al.

(10) Patent No.: US 6,336,763 B1
(45) Date of Patent: Jan. 8, 2002

(54) APPLICATOR FOR FLOWABLE SUBSTANCES

(75) Inventors: Donald P. Losier, Chester; Van Canady, Princeton, both of NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 09/407,441

(22) Filed: Sep. 29, 1999

Related U.S. Application Data

(63) Continuation-in-part of application No. 09/168,144, filed on Oct. 7, 1998, now abandoned.

(51) Int. Cl.[7] ..... B43K 5/00
(52) U.S. Cl. ..... 401/205; 401/266; 401/265
(58) Field of Search ..... 401/205, 266, 401/196, 265, 171, 175

(56) References Cited

U.S. PATENT DOCUMENTS

| | | | | |
|---|---|---|---|---|
| 519,051 A | | 5/1894 | Terry | |
| 555,763 A | | 3/1896 | Fessenden | |
| 718,969 A | * | 1/1903 | Altshul | 401/266 |
| 1,968,686 A | | 7/1934 | Janer | |
| 2,557,221 A | | 6/1951 | Gazda | |
| 3,409,186 A | | 11/1968 | Melocchi | |
| D216,294 S | | 12/1969 | Rias | |
| 3,858,762 A | | 1/1975 | Meshberg | |
| D248,214 S | | 6/1978 | DiNuccio | |
| 4,138,039 A | | 2/1979 | Micallef | |
| 4,185,776 A | | 1/1980 | Nozawa | |
| 4,223,999 A | * | 9/1980 | Wells | 401/176 |
| 4,225,254 A | | 9/1980 | Holberg et al. | |
| 4,333,589 A | | 6/1982 | Bush | |
| 4,353,956 A | | 10/1982 | Nalle | |
| 4,492,223 A | | 1/1985 | Burke | |
| 4,567,011 A | | 1/1986 | Nalle | |
| 4,571,106 A | | 2/1986 | Scuderi | |
| D285,172 S | | 8/1986 | Scuderi | |
| 4,801,052 A | | 1/1989 | Citterio | |
| 4,842,794 A | | 6/1989 | Hovis et al. | |
| 4,865,231 A | | 9/1989 | Wiercinski | |
| D308,330 S | | 6/1990 | Teece | |
| D308,476 S | | 6/1990 | Rosenberg | |

(List continued on next page.)

FOREIGN PATENT DOCUMENTS

| | | | | |
|---|---|---|---|---|
| DE | 828820 | * | 1/1952 | 401/266 |
| DE | 34 02 614 A1 | | 8/1985 | |
| EP | 310 448 A | | 4/1989 | |
| IT | 457629 | | 5/1950 | |
| SE | 82697 | | 2/1935 | |

* cited by examiner

*Primary Examiner*—David J. Walczak
(74) *Attorney, Agent, or Firm*—Michael J. McGreal

(57) ABSTRACT

The dispenser has a mesh fabric applicator surface which provides for a uniform flow of the semisolid substance to be dispensed, but does not have the problem of post-extrusion flow. That is, there is not required such an overpressure to start the flow of the substance, with this overpressure remaining after use of the applicator and causing the semi-solid substance to extrude through the applicator surface after use. The mesh fabric surface can be a woven or nonwoven fabric, in one or more plies. Nonwoven fabrics include apertured extruded films. The mesh fabric is heat bonded to the upper frame of the applicator and can have an underlying support. The mesh fabric can yield to follow the contours of a skin surface, but will not be permanently distorted. There is provided a surface for a dispenser for a viscous semisolid substance where there is improved shear of the semisolid substance and a more uniform application. Also, due to the more uniform cross-sectional dimension of the pores, there is obviated the problem of post-extrusion flow.

27 Claims, 1 Drawing Sheet

U.S. PATENT DOCUMENTS 4,931,484 A 6/1990 Hovis et al.
4,961,661 A 10/1990 Sutton et al.
5,088,849 A 2/1992 Johnson et al.
5,092,468 A 3/1992 Slocumb
5,098,782 A 3/1992 Hovis et al.
5,111,972 A 5/1992 Sakurai et al.
5,139,180 A 8/1992 Lucas
D332,914 S 2/1993 Stephens
D333,191 S 2/1993 Rainen
D334,712 S 4/1993 Turner-Adams
5,207,962 A 5/1993 Hovis et al.
5,234,136 A 8/1993 Kopis
D340,865 S 11/1993 Endre
5,277,515 A 1/1994 Hovis et al.
5,308,182 A 5/1994 Lampert
5,320,259 A 6/1994 Weinstein
5,372,285 A 12/1994 Harrold et al.
5,460,878 A 10/1995 Hostetter
5,489,437 A 2/1996 Marra
5,540,361 A 7/1996 Fattori
5,547,302 A 8/1996 Dornbusch
5,570,821 A 11/1996 DeJonge
5,573,341 A 11/1996 Iaia
5,725,133 A 3/1998 Iaia
5,743,441 A * 4/1998 Baudin et al. ..... 222/212
5,772,347 A 6/1998 Gueret
5,839,622 A 11/1998 Bicknell et al.
5,860,572 A 1/1999 Harrold et al.

APPLICATOR FOR FLOWABLE SUBSTANCES

This a continuation-in-part-of pending prior application Ser. No. 9/168,144, now abandoned filed Oct. 7, 1998 which application is now pending and is incorporated herein by reference.

FIELD OF THE INVENTION

This invention relates to an applicator for semisolid substances such as gels, solutions and emulsions onto a body surface. More particularly this invention relates to an applicator of semisolid substances without the need for any pressure compensating mechanisms.

BACKGROUND OF THE INVENTION

There is a continual search for better ways to apply a lotion, gel, solution or emulsion to the skin surface. The substance can be a deodorant, antiperspirant, suntan lotion, poison ivy preparation or some other substance which is to be delivered to the skin. Since the substance is only a semisolid, it cannot function as the applicator surface. Solid stick deodorants and antiperspirants function as the applicator surface. No separate applicator surface is needed. However, with semisolid substances a separate applicator surface is needed.

There are several different types of applicator surfaces that have been and are being used. In U.S. Pat. No. 4,801,052 and U.S. Pat. No. 5,372,285 there is disclosed a rigid applicator section that has a plurality of apertures. The semisolid material flows directly through the holes in the rigid surface and is applied to a body surface. These apertures can be of varying shapes and sizes, and in varying numbers. This is exemplified in the commercial Mennen Speed Stick gel products and the Right Guard gel products.

Another applicator for semisolid products is to use a Porex applicator surface. Porex is a sintered plastic material that has random, nonlinear, branched pores of varying cross-sectional diameters. Also, the pores are much smaller in cross-section than the apertures of U.S. Pat. No. 4,801,052 or U.S. Pat. No. 5,372,285. In these porous applicators the individual pores will be in a varying diameter of about 150 to 400 microns. This is much smaller than the apertures of the above two U.S. Patents. However, these porous materials pose a post-extrusion problem. Post-extrusion is the continued flow of the semisolid substance after the cessation of the force to push the semisolid substance through the applicator surface. This is a problem since it flows after the application of the product, is wasted product, and is considered as being messy.

This problem has been addressed by incorporating a pressure relief mechanism into the dispenser. Such pressure relief mechanisms are shown in U.S. Pat. No. 5,540,361 and U.S. Pat. No. 5,547,302. These pressure relief mechanisms allow the elevator to recede away from the applicator surface in a dispensing stroke. This relieves most of the pressure in the applicator that would cause post-extrusion through the applicator surface.

U.S. Pat. No. 5,547,302 also discloses the use of a mesh as the applicator surface. This mesh is comparatively thin and flexible with a plurality of discrete openings extending through the mesh. This can be from the structure of a screen to a rigid structure. In the Example the mesh thickness is 0.022 inches. However, regardless of its structure or thickness, the mesh structure has a post-extrusion problem. The dispenser with this mesh applicator surface requires the use of a pressure relief mechanism in conjunction with the elevator of the dispenser. As with the Porex microporous applicator surfaces, there is needed a mechanism to prevent any substantial post-extrusion. However, all of these pressure relief mechanisms add to the complexity and cost of the dispenser.

The present invention solves this problem. Semisolid substances can be delivered through an application surface having pore-like openings without the problem of post-extrusion. This is accomplished by the use of one or more plies of a mesh fabric. The fabric has substantially linear openings through the fabric. Whether there will be one ply or a plurality of plies will depend on many factors including the structure of the fabric. This will depend to a large degree on the fiber denier and the weave of the fabric if it is a woven fabric, the size of the apertures for an extruded nonwoven film fabric, and the porosity of the fabric if it is a nonwoven with random arrayed fibers. One objective is to have fabric of a material that is heat bondable to a peripheral frame edge and through which a product of a rheology of about 10,000 centipoises to about 1,000,000 centipoises can flow without any substantial post extrusion. It is preferred in the present dispenser to use a single ply fabric of a denier and weave that maintains its structural integrity in use to apply a substance to the skin, with or without the use of an underlying support structure. That is, there is no folding or undue distortion of the fabric surface during the application of the semi-solid substance. Some flexing is desired in order to follow the contours of the skin. However, this flexing should not result in any permanent distortion of the fabric surface.

As an option a plurality of fabric plies can be used. In such an instance there will be from about 2 to 10 plies, and preferably 2 to 5 plies. By randomly overlaying plies of the fabric, the openings are partially juxtaposed from ply layer to ply layer. This provides for a modified circuitous path of the substance through the mesh fabric. An additional force is needed to flow the semisolid substance through the multi-ply fabric structure versus a single ply structure, but not a force that would result in any significant post-extrusion or leakage of the semisolid substance. The applicator fabric will be matched to the viscosity of the formulation. The flow through the fabric plies is substantially simultaneous with the application of pressure to the semisolid product with there being no pressure to be dissipated after the use of the dispenser.

In addition to the advantages of no substantial post-extrusion the use of a mesh fabric provides for an improved product shearing of the semi-solid substance and more uniform application to the contours of the body surface. Improved shearing allows for the application of a thinner continuous layer of the semisolid substances onto the skin.

BRIEF DESCRIPTION OF THE INVENTION

The present invention is directed to a dispenser with an applicator surface that does not require a pressure relief mechanism to prevent the post-extrusion of the substance being dispensed. The applicator surface is comprised of one or more layers of a mesh fabric. The structure of the fabric will depend on whether the fabric is woven or nonwoven. A nonwoven fabric includes extruded films having apertures and fabrics of a layer of random arrayed fibers. When a plurality of plies are used, the plies can be in a designed array or in a random array. The result in the use of a plurality of plies is a plurality of offset passageways. This arrangement of offset passageways provides for some back pressure in the dispensing of the semisolid substance, but not a pressure that would result in any significant post-extrusion flow. The flow ceases fairly quickly upon the cessation of the application pressure since the application pressure is quickly relieved by the direct flow of the semisolid substance. The fabric can be used with or without an underlying support. Whether in the form of a single or multiple ply, there is provided a surface that will conform to the small undulations in the body surface to which the semisolid is being applied.

The fabric can be a woven or a nonwoven fabric. If woven it can have a plain twill or satin weave. The weave also can be a tight or a loose weave. Further, the fibers that comprise the fabric can be in a range of deniers. If nonwoven, the fabric can be an extruded film with microporous apertures or can be produced by one or more random layers of fibers that are bonded together. The only requirements are that the fabrics be thermoplastic and be heat bondable to a thermoplastic frame, and that in use as an applicator surface for a viscous semisolid substance that there be no significant post-extrusion of the viscous semisolid after application to a skin surface. If woven, the mesh apertures will be more uniform in structure. Whether woven or nonwoven, the applicator surface will be comprised of about 1 ply to about 10 plies of fabric, preferably about 1 ply to about 5 plies and most preferably about 1 to 3 plies. The mesh openings nominal (average) size will be in the range of about 50 microns to about 1,000 microns, and preferably about 80 microns to about 400 microns. In a multilayer structure the mesh openings in one layer usually will not align with the mesh openings of another layer. However, the mesh openings can be arranged to be aligned from layer to layer. Further, the mesh openings can vary in size from layer to layer. The mesh openings will have a nominal surface area of about $2.5\times10^{-3}$ $mm^2$ to about 1 $mm^2$ and preferably about $6.4\times10^{-3}$ $mm^2$ to about 0.16 $mm^2$. This variability in alignment and in mesh size can accommodate compositions of different rheologies. The rheology of the composition to be delivered and the mesh opening size or sizes are coordinated in order to deliver a viscous product without the need for a pressure relief mechanism in the dispenser.

The mesh fabric will have a thickness of about 0.032 centimeters to about 0.30 centimeters and preferably 0.041 centimeters to about 0.15 centimeters. The mesh fabric provides a variation of skin feel in the application of substances. By varying the fabric material and the size of the aperture openings, the skin feel can be changed from soft and smooth to a noticeable skin rubbing. There can be a low to high degree of skin friction. The skin feel also can be changed by calendaring the sheet material to change surface characteristics such as the coefficient of friction.

The applicator support structure can be comprised of a plurality of support ribs across the major axis or minor axis of the dispenser. Such ribs preferably would have a radius of curvature of about 10 centimeters to about 20 centimeters along the major axis and about 2.54 to 7.62 centimeters about the minor axis. These ribs support the fabric in a compound curve structure. They allow some flex in the fabric but do not allow for any permanent distortion of the fabric. Optionally the support structure can be a rigid apertured section. In this embodiment there will be no flex to the fabric surface.

In one mode of use a knob in a lower part of the dispenser will be rotated to move an elevator in the dispenser upward. This will provide for a flow of some of the viscous semisolid substance supported on the elevator through the fabric applicator surface. There is no discernible post-extrusion flow of the semisolid substance after the dispensing of the desired amount of the semisolid substance and the application of this substance to a body surface. The internal pressure in the dispenser is rapidly equilibrated with the exterior pressure upon the movement of the elevator to dispense the semisolid substance. There is no resulting back pressure after the use of the dispenser to cause any significant post-extrusion of the semisolid substance.

DETAILED DESCRIPTION OF THE INVENTION

Figure 1:
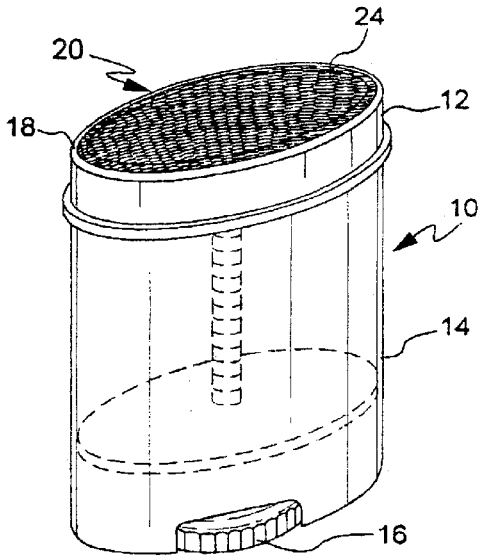
FIG. 1 is a perspective view of the dispenser with a woven fabric applicator surface.

The present dispenser will be described with respect to woven and nonwoven fabrics, the use of layers of the fabrics, and the use of both woven and nonwoven fabrics in different combinations. One objective is to deliver a viscous semisolid liquid from a dispenser without any post extrusion. Upon the cessation of pressure on the viscous, semisolid liquid, there is a cessation of extrusion through the fabric dispensing surface. The problem of post extrusion also is alleviated by the low degree of flex in the surface of the fabric.

Another objective is to provide an applicator where the surface will have sufficient flex to contact the contours of the body surface to which the viscous semisolid material is being applied, but will not be permanently distorted. Yet, another objective is by the range of fabrics available, the structure of these fabrics, and the structure of the fabrics in a single or multi-ply arrangement the skin feel of the applicator can be changed. Some persons want a smooth feel while others want a relatively rough feel. Also, some formulations will have a lubricating effect and consequently, a rougher feel may be desired. In any regards the skin feel of the applicator surface can be changed by changing the mesh fabric.

Whether woven or nonwoven, the applicator surface will be comprised of about 1 ply to about 10 plies of fabric, preferably about 1 ply to 5 plies, and most preferably about 1 to 3 plies. The mesh openings nominal size will be in the range of about 50 microns to about 1,000 microns, and preferably about 80 microns to 400 microns. In multilayer structures the mesh openings in one layer usually will not align with the mesh openings of another layer. However, the mesh openings can be aligned from layer to layer. Further, the mesh openings can vary in size from layer to layer. The mesh openings will have a nominal (average) surface area of about $2.5\times10^{-3}$ $mm^2$ to about 1 $mm^2$ and preferably about $6.4\times10^{-3}$ $mm^2$ to about 0.16 $mm^2$.

If a woven fabric the fabric can be of any of the three basic weaves. These are the plain, twill or satin weaves. If a plain weave this can be a regular plain weave, oxford weave, lousine weave, 2×2 basket weave, 3×2 basket weave, 3×3 basket weave, 4×4 basket weave, 4×5 basket weave, 3×5 basket weave and an 8×8 basket weave. In addition the fabric can be of a rip stop parachute type. In this type of weave there is an intermittent weave to stop any rips in the fabric. The twill fabrics can be a 2/1 right hand twill, a 1/2 right hand twill, a 2/2 right hand twill, a 3/1 right hand twill, a 3/1 45° right hand twill. The satin fabrics can be a 4 harness satin (i.e. crowfoot), 5 harness satin, 6 harness satin, a 7 harness satin or an 8 harness satin. These are all forms in which the fibers are interlaced in the warp and fill directions. The warp threads usually are called ends while the filling threads are called picks. The edges of the fabric are is the selvage.

The construction of a woven fabric is given as ends x picks per inch. The weave can be balanced where there is the same number of threads in the warp direction and in the filling direction. In an unbalanced weave there will be more threads either in the warp direction or in the filling direction.

The tightness for a fabric can be calculated by the formula:

$$\text{Weave Texture} = \frac{\text{ends per repeat}}{\text{Inch per repeat} + \text{interlacings}}$$

This same formula can be used to calculate the maximum cover for a fabric.

Also of importance is the denier of the threads. Denier is the weight in grams for 9000 meters of a thread. A low denier indicates a fine, relatively narrow cross-section thread. A higher specific gravity material at a given denier will have a smaller cross-section than a lower specific gravity material at that same denier.

There are many variables in the selection of a woven fabric. By the selection of the weave style, fabric tightness, fiber material, fiber structure and fiber denier, the texture of the fabric can be changed. The skin feel can range from smooth to rough. By calendaring or similarly treating the fabric, the surface of the fabric can be modified to produce a smoother texture and skin feel. The skin feel and the application also can be adjusted by the tension on the fabric in its attachment to the applicator frame. The flexibility of the fabric can be modified. Also, the fabric can be supported or unsupported. If supported, it can be supported along the major axis and/or along the minor axis; assuming the usual oval shape of an applicator surface. If the applicator is round, it can be supported by means of one or more diametric supports.

If the fabric is nonwoven, it can be an extruded film that by its structure is porous, or is a solid film which is perforated to make it porous. In addition, a nonwoven fabric can be comprised of a plurality of random short length fibers that are layed down in a random array and then selectively bonded together adhesively or by heat bonding. The former extruded apertured films can be produced by the processes disclosed in U.S. Pat. No. 4,842,794 or U.S. Pat. No. 5,207,962. In U.S. Pat. No. 4,842,794 a sheet of thermoplastic film is extruded to a thickness of about 0.5 to 20 mils. One side of the film is provided with about 4 to 60 grooves per centimeter and the other side a set of grooves at an acute angle of 15° and 75°. The embossing rolls that have the patterns are at a pressure of about 4 to 120 pounds per linear centimeter. The result is a film with oval apertures. The film then can be uniaxially oriented in the machine or cross direction from about 50% to 500%, or sequentially biaxially oriented in the machine direction and cross direction up to about 600%. In the alternative the extruded and apertured film can be heat treated to increase the size of the apertures.

In the processes of U.S. Pat. No. 5,207,962 a thermoplastic film is extruded with the extruded film passed between a patterned nip roll and a smooth roll. The patterned nip roll has a plurality of raised projections with a sharp distal end. These sharp raised projections from the apertures in the film. The apertured film then can be uniaxially oriented in the machine or cross direction or biaxially oriented in both the machine direction and cross direction. The apertures will be of the shape and size of the distal end of the raised projections. The apertures also will be in a consistent repeating pattern. These extruded films are a class of nonwoven fabrics for the purposes of this invention.

The extruded film also can be produced in the form of a sheet or in a plurality of strands. When extruded in the form of strands, these strands are in a sheet in a helical type of pattern. This also is known as a biplanar netting. The film that is produced in the form of helical strands can have 7 to 50 strands or more per 2.54 cm, be in a width of about 30 cm to 152 cm and a thickness of 0.033 cm to 0.30 cm, and preferably about 0.05 to about 0.15 cm. The apertures can be in a size range of 100 to 500 micron and larger. The open area of the extruded strand type film can range from about 4% to 25% or more. Larger openings will provide a greater open area. Useful nonwoven netting products are the Naltex® products of Nalle Plastics, Inc.

Preferred extruded films have about 20 to about 50, and preferably about 30 to about 40, strands per 2.54 cm and have nominal openings of about 125 microns to about 225 microns. A nominal opening is the average size of a square opening with the length and width being about these dimensions. This translates to a nominal mesh area opening of about 0.015 $mm^2$ to about 0.05 $mm^2$. The shape of the opening can vary from triangular to polygonal to circular or elliptical. However, the area of the mesh opening will be within the above range. The mesh openings will be within a given range, however, there will be a range of shapes and sizes with the average mesh opening size being the given range.

In FIG. 1 there is shown a dispenser for an antiperspirant or deodorant. The container 10 has an upper portion 12, a barrel body portion 14 and a knob 16 for raising an elevator in the container. The upper portion 12 is comprised of insert 20 which is comprised of support frame 18 and fabric 26. The support frame 18 is in a liquid tight contact with the barrel body portion 14. The insert can be mechanically attached to the barrel or it can be thermally or adhesively bonded to the barrel.

Essentially any barrel portion, elevator and knob can be used with the dispensers of the present invention. The key feature is the insert through which the viscous semisolid is dispensed. The insert 20 is comprised of support frame 18 and fabric 26 with applicator surface 24. The fabric 26 can be mechanically held onto the support frame, can be adhesively or heat bonded to the insert, or it can be injection molded to the support frame during the molding of the support frame. The latter technique of insert molding the fabric applicator surface to the support frame is preferred.

Figure 8:
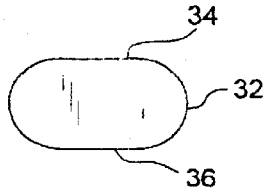
FIG. 8 is a cross-sectional view of a fabric strand after injection molding.

In a preferred embodiment the fabric is insert injection molded to the fabric support frame during the formation of the support frame and the fabric is simultaneously surface modified during this process. The surface of the fabric is modified by the substantially round fabric fibers being modified to flat upper and lower surfaces. The substantially circular fiber 32 is modified to have the shape of a chord of a circle 34 on its upper and 36 lower surfaces and forms an oval-like shape as shown in FIG. 8. This flat upper surface tends to decrease the coefficient of friction of the fabric surface and results in a smooth skin feel in use. That is, the applicator surface moves over the skin with less friction. The thickness of the fiber from upper surface to lower surface is decreased about 5% to about 25%, and preferably about 8% to 15% during the insert injection molding process.

The mesh size also is changed during insert injection molding. The mesh aperture opening size will be reduced about 5% to about 25%. Consequently, the initial fabric mesh size will have to be sized to take into consideration the decrease in mesh size during insert molding. In the insert injection molding process the mesh fabric is placed in the mold cavity. The cavity is shaped to accept the fabric with the edges of the fabric being in a border area. The border area is where the support frame of the insert is to be formed. A mating mold section is inserted into the cavity and a pressure applied to the mold pieces. The mold sections in contact with the fabric will have a compound curve shape which shape will be imparted to the fabric on the support frame. Hot plastic is injected into the closed mold through channels to form the insert frame. Upon contact with the mesh fabric edge, the hot plastic bonds to the mesh fabric. Also, in this process the pressure of the mold pieces against each other will change the shape of the fabric fibers from round to a chordal shape and impart a compound curve shape to the fabric portion.

Figure 5:
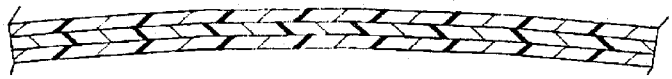
FIG. 5 is a side cross-sectional view of a multi-ply fabric as the dispensing surface.

In insert molding the frame will have an upper rim 30 to which the fabric is attached. In a preferred mode the upper rim 30 will be at an angle of about 5° to about 50° to a horizontal plane through the insert support frame 18. This upward extending angle from the outer edge 22 of rim 30 to the inner edge 28 of rim 30 aids in providing a compound curve to the fabric as shown in FIG. 5.

Figure 2:
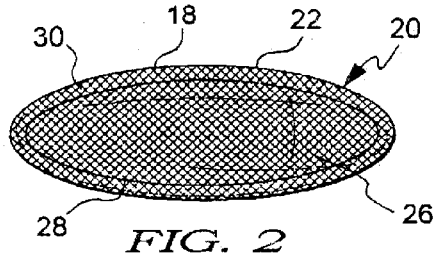
FIG. 2 is a is a top plan view of the dispenser of FIG. 1.
Figure 3:
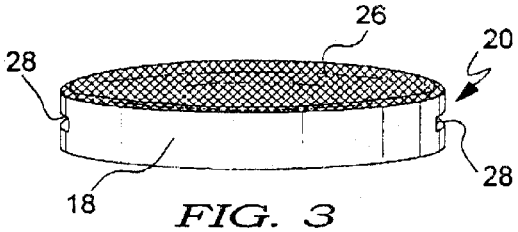
FIG. 3 is a is a side elevational view of the dispensing surface and frame for the dispenser of FIG. 1.

A woven fabric injection molded to an insert is shown in a top plan view in FIG. 2 and in a side elevation view in FIG. 3. In FIG. 2 the woven fabric 26 is shown injection molded to the rim 30 of the insert support 18. In this injection molding, usually the fabric 26 and the insert support will be constructed of the same plastic. However, this is not required. Usually these will be polyenes such as polyethylenes, polypropylenes, polybutadienes and copolymers and polymers. However, other thermoplastics such as polyesters can be used. In FIG. 3, the insert 18 is shown in a form for mechanical attachment to upper portion of the barrel 72. Recess 28 locks into a complimentary rib on the upper portion. The fabric 26 can be held in a compound curve shape by structural supports located below the fabric. These structural supports are shown in more detail in FIG. 6 and FIG. 7.

Figure 4:
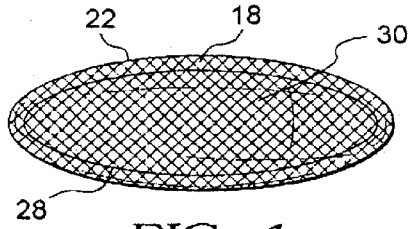
FIG. 4 is a is a top plan view of a dispenser with an extruded apertured film applicator surface.

FIG. 4 shows an insert support frame with a nonwoven fabric heat bonded to the rim 30. The structure of the insert support frame is the same as in FIG. 2 and FIG. 3. The difference is the use of a fabric that has random sized openings within a particular range. As in the embodiment of FIG. 2, in the embodiment of FIG. 4 the fabric can be in multiple layers. This usually would be in about 1 to about 5 layers, and most preferably about 1 to about 3 layers. FIG. 5 shows a fabric structure in a three-layer arrangement.

Figure 6:
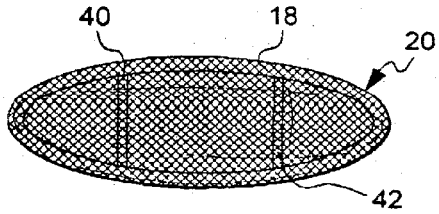
FIG. 6 is a is a top plan view of the support for the fabric of the applicator surface.
Figure 7:
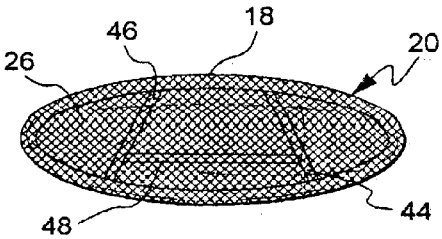
FIG. 7 is a is a top plan view of an alternative support for the fabric applicator surface.

As previously noted, FIG. 6 and FIG. 7 show support structures for the fabric. These support structures will maintain the fabric in a compound curve structure. The fabric can be maintained in a single curved surface. However, in most uses the preference will be to maintain the fabric in a compound curve structure. In FIG. 6 there are shown supports 40 and 42 which support the fabric in a compound curve. A different arrangement of supports is shown in FIG. 7. Here supports 44, 46, and 48 maintain the fabric in a compound curve structure.

The mesh fabric can be comprised of essentially any material in which these fabrics are constructed, however, thermoplastic fabrics are preferred since they can more easily be bonded to a support frame. Preferred mesh fabrics are polyene fabrics, polyester fabrics, nylon fabrics, and polyester-elastomer fabrics. The polyene fabrics comprise a class of polyethylene, polypropylene, polybutadiene polymer fabrics and fabrics that include copolymers of these polyenes. The mesh fabrics have mesh openings of about 50 microns to about 1,000 microns, and preferably about 80 microns to about 400 microns. The open area will be from about 4% to about 25%. The thickness of the mesh fabric will be about 0.02 centimeters to about 0.35 centimeters. Preferably the mesh fabric and the support frame are constructed of the same thermoplastic material in order to facilitate the bonding of the mesh fabric onto the support frame.

The other parts of the dispenser are constructed of the materials commonly used for such dispenser. These are moldable thermoplastics. Most, if not all, of the parts of the dispenser will be injection molded.

What is claimed is:

1. An applicator for semisolid antiperspirant and deodorant substances comprising a barrel closed at one end by an elevator adapted to move axially within said barrel, and closed at another end by an applicator surface, said applicator surface comprised of at least one of a woven and a nonwoven fabric having a modified surface with regard to texture and skin feel, said fabric insert molded to a support frame in a stretched condition, said fabric having nominal mesh apertures of about 50 microns to about 1,000 microns in cross-section and a thickness of about 0.032 cm to about 0.3 cm, said semisolid substance flowing through said applicator surface with substantially no post-extrusion flow.

2. An applicator as in claim 1 wherein said modified surface has been calendared.

3. An applicator as in claim 2 wherein said applicator surface is comprised of 1 to 10 plies of fabric.

4. An applicator as in claim 3 wherein said applicator surface is comprised of 1 to 5 plies.

5. An applicator as in claim 2 wherein said fabric is a woven fabric.

6. An applicator as in claim 2 wherein said applicator surface is a woven fabric selected from the group consisting of plain weaves, twill weaves and satin weaves.

7. An applicator as in claim 2 wherein said applicator surface is a nonwoven fabric.

8. An applicator as in claim 7 wherein said nonwoven fabric is an extruded film having a plurality of apertures.

9. An applicator as in claim 7 wherein said nonwoven fabric is a plurality of random fibers in a random array.

10. An applicator as in claim 2 wherein there is at least one support beneath said applicator surface.

11. An applicator as in claim 10 wherein said applicator has a major axis and a minor axis, said support extending across said major axis.

12. An applicator as in claim 11 wherein said support forms said applicator surface into a compound curve.

13. An applicator as in claim 2 wherein said applicator surface is one of a polyene and a polyester.

14. An applicator as in claim 2 wherein said fabric has apertures of about 75 microns to about 350 microns.

15. An applicator as in claim 14 wherein said fabric has apertures of about 100 microns to about 250 microns.

16. An applicator for a semisolid substance comprising a barrel closed at one end by an elevator adapted to move axially within said barrel, and closed at another end by an applicator surface, said applicator surface comprised of an extruded film having about 20 to about 50 strands per 2.54 cm and nominal mesh apertures of about 100 microns to about 500 microns and a thickness of about 0.033 cm to about 0.30 cm, said extruded film insert molded to a frame insert said strands having a modified top surface.

17. An applicator as in claim 16 wherein said modified surface has been calendared.

18. An applicator as in claim 17 wherein said extruded film has nominal mesh apertures of about 125 to about 225 microns.

19. An applicator as in claim 17 wherein said applicator surface has mesh openings each having an open area of about $2.5\times10^{-3}$ $mm^2$ to about 1 $mm^2$.

20. An applicator as in claim 17 wherein said extruded film has about 30 to 40 strands per 2.54 cm.

21. An applicator as in claim 17 wherein said extruded film has a thickness of about 0.05 cm to about 0.15 cm.

22. A method of forming an applicator surface for the application of flowable substances to a body surface comprising:

providing at least one of a woven and a nonwoven fabric;

modifying an upper surface of said fabric;

inserting said fabric into a first section of an injection mold, the fabric extending substantially across a cavity of said first mold section;

inserting a mating second mold section into said first mold section; and injecting a hot thermoplastic plastic into at least one of said first and second mold sections to simultaneously form a support frame for said fabric and to bond said fabric to said support frame.

23. A method as in claim 22 wherein said first mold section and said second mold section hold said fabric in a compound curve shape.

24. A method as in claim 23 wherein said first mold section and said second mold section form an angle of about 5° to about 50° to a horizontal plane through said support frame on the upper edge of said support frame whereby said fabric is further formed into said compound curve shape.

25. A method as in claim 22 wherein said fabric is an extruded film having from about 20 to 50 strands per 2.54 cm and nominal mesh aperture of about 100 microns to about 500 microns.

26. A method as in claim 25 wherein said fabric has about 30 to 40 strands per 2.54 cm and nominal mesh apertures of about 125 microns to about 250 microns.

27. A method as in claim 22 wherein said upper surface is modified by calendaring.

* * * * *